US011585064B2

(12) United States Patent
Olsen et al.

(10) Patent No.: US 11,585,064 B2
(45) Date of Patent: Feb. 21, 2023

(54) HOLLOW SUBSEA FOUNDATIONS

(71) Applicant: Subsea 7 Norway AS, Stavanger (NO)

(72) Inventors: Christian Linde Olsen, Stavanger (NO); Stylianos Panayides, Aboyne (GB)

(73) Assignee: Subsea 7 Norway AS, Stavanger (NO)

( * ) Notice: Subject to any disclaimer, the term of this patent is extended or adjusted under 35 U.S.C. 154(b) by 0 days.

(21) Appl. No.: 16/907,148

(22) Filed: Jun. 19, 2020

(65) Prior Publication Data

US 2020/0399851 A1 Dec. 24, 2020

(30) Foreign Application Priority Data

Jun. 21, 2019 (GB) ..... 1908909

(51) Int. Cl.

| | |
|---|---|
| ***E02D 27/52*** | (2006.01) |
| ***E02D 15/08*** | (2006.01) |
| ***E02B 17/02*** | (2006.01) |
| ***E02D 5/24*** | (2006.01) |
| ***E02D 7/00*** | (2006.01) |
| ***E02D 7/20*** | (2006.01) |
| ***E02D 29/09*** | (2006.01) |
| *E02B 17/00* | (2006.01) |

(52) U.S. Cl.

CPC ..... *E02D 27/525* (2013.01); *E02D 5/24* (2013.01); *E02D 7/00* (2013.01); *E02D 7/20* (2013.01); *E02D 15/08* (2013.01); *E02D 29/06* (2013.01); *E02B 2017/0078* (2013.01); *E02D 2250/00* (2013.01); *E02D 2250/0053* (2013.01)

(58) Field of Classification Search

CPC . E02B 2017/0078; E02D 15/08; E02D 27/52; E02D 27/525

USPC ..... 405/224.1

See application file for complete search history.

(56) References Cited

U.S. PATENT DOCUMENTS 3,640,075 A * 2/1972 La Peyre ..... E02B 3/068 405/23
3,817,040 A 6/1974 Stevens
3,928,982 A * 12/1975 Lacroix ..... E02D 27/52 405/224

(Continued)

FOREIGN PATENT DOCUMENTS

EP 1 264 067 9/2001
EP 1 881 113 1/2008

(Continued)

OTHER PUBLICATIONS

DNV-RP-E303 Recommended Practice, "Geotechnical Design and Installation of Suction Anchors in Clay" (2017).

*Primary Examiner* — Frederick L Lagman
(74) *Attorney, Agent, or Firm* — Levy & Grandinetti

(57) ABSTRACT

A method of installing an upright elongate hollow subsea foundation that is higher than it is wide, such as a suction pile. The foundation is at least partially embedded in seabed soil. A partition layer is placed within the foundation, for example by injecting a grout, supported by a plug of soil that is surrounded by the foundation. The partition layer is placed on the plug of soil at a level that is spaced from the top of the foundation by at least 20% of the height of the foundation. Above the partition layer, the interior of the foundation may be filled with water and/or a rigid body, such as a solid mass or a hollow liquid-filled tank.

29 Claims, 18 Drawing Sheets

(56) References Cited

U.S. PATENT DOCUMENTS

Figure 1A:
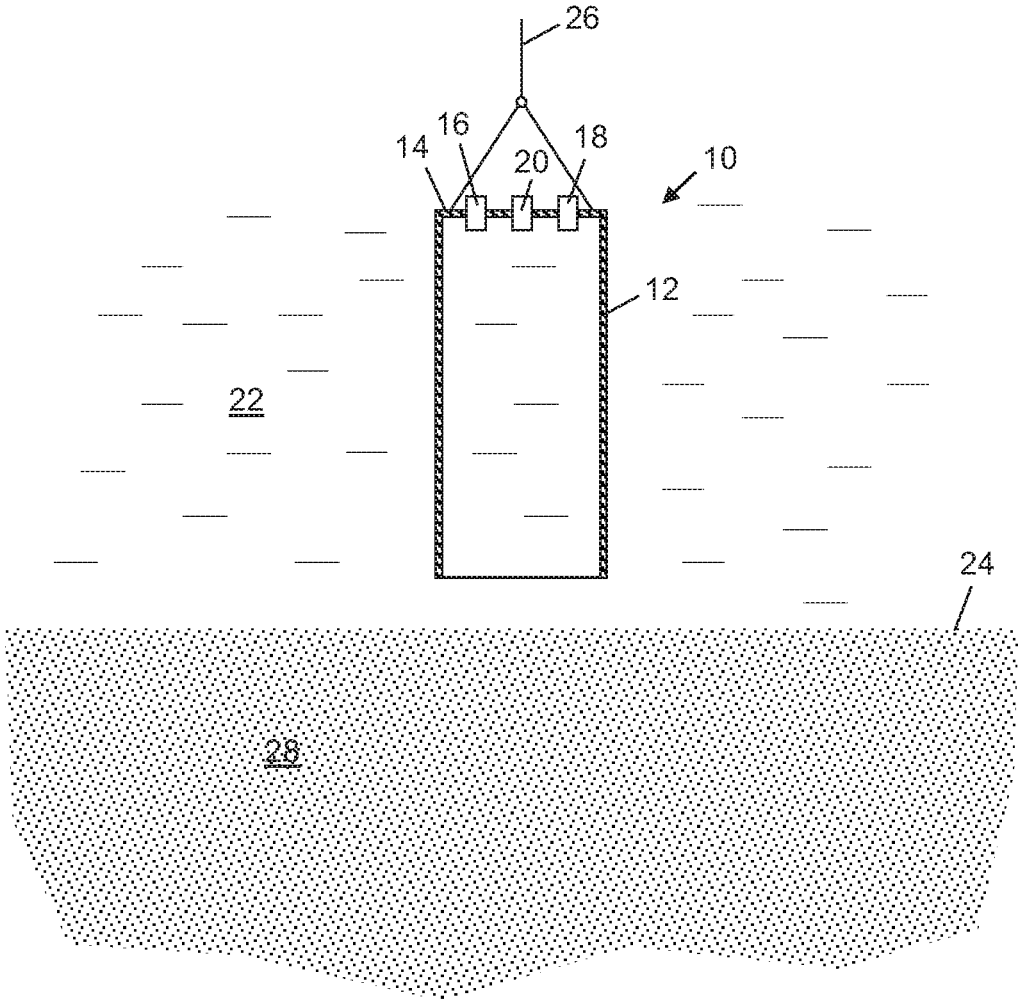

| | | | | |
|---|---|---|---|---|
| 4,432,671 | A | 2/1984 | Westra et al. | |
| 6,692,194 | B2 | 2/2004 | Strand | |
| 10,961,680 | B2 * | 3/2021 | Olsen | E02D 27/42 |
| 2010/0021241 | A1 * | 1/2010 | Thomas | B63B 21/27 405/224.1 |

FOREIGN PATENT DOCUMENTS

| | | | | |
|---|---|---|---|---|
| EP | 3 222 783 | | 9/2017 | |
| GB | 1 451 537 | | 10/1976 | |
| GB | 2 097 739 | | 4/1981 | |
| KR | 20150026428 | | 3/2015 | |
| KR | 2016059571 | * | 5/2016 | E02B 2017/0078 |
| WO | WO 02/063106 | | 8/2002 | |
| WO | WO 2014/084737 | | 6/2014 | |
| WO | WO 2014/088770 | | 6/2014 | |
| WO | WO 2014084737 | * | 6/2014 | E02D 27/525 |
| WO | WO 2017/179992 | | 10/2017 | |

* cited by examiner

HOLLOW SUBSEA FOUNDATIONS

This invention relates to hollow, especially tubular, subsea foundations that are designed to be embedded into the seabed, such as caissons and suction piles. The invention aims particularly to strengthen such foundations when they are installed in soft seabed soils.

Suction piles are commonly used in the subsea oil and gas industry for supporting or anchoring large offshore installations in deep water. Such piles are therefore designed to engage the soft seabed soils that characterise deep water, typically comprising marine sediments or soft clays.

Suction piles are also known in the art as suction anchors, suction cans, suction caissons or suction buckets. The design of such foundations may be determined with reference to standards such as DNV-RP-E303, entitled *Geotechnical Design and Installation of Suction Anchors in Clay.*

Suction piles engage the seabed soil by friction and/or by cohesion attributed to van der Waal forces. The engagement mechanism depends upon the composition of the soil. For example, engagement of a suction pile with a sandy seabed is based more on friction whereas engagement with a clay seabed is based more on cohesion.

A suction pile is usually fabricated from steel and typically comprises a deep cylindrical skirt defining an open-bottomed hollow straight tube. The skirt engages the seabed soil by friction or cohesion upon being embedded axially into the soil.

The top of the skirt is closed by a steel top plate. This defines a suction chamber between the top plate, the skirt and the seabed soil trapped within the embedded skirt. Underpressure in the suction chamber also promotes engagement of the suction pile with the seabed. The undrained condition of the seabed soil makes suction very efficient.

The top plate may comprise openable hatches or may be attached to the skirt only after the skirt has been lowered to the seabed. This reduces drag and improves stability while lowering the suction pile, or the skirt, through the water.

When a suction pile is landed on the seabed in an upright orientation, the skirt embeds partially into the seabed soil under the self-weight and momentum of the pile. The soil within the embedded skirt closes the bottom of the pile to create the suction chamber. When seawater is subsequently pumped out of the suction chamber as disclosed in GB 1451537, the resulting underpressure in the chamber draws the top plate toward the seabed. This causes the skirt to sink further into the soil as the suction chamber contracts under external hydrostatic pressure, hence effecting fuller engagement of the suction pile with the seabed. In deep water, suction is generally applied by using a remotely-operated vehicle or ROV to pump water from the suction chamber.

Consequently, a suction pile engages with the seabed by virtue of a combination of friction or cohesion and suction. The installation method reflects these factors, firstly by allowing the pile to self-penetrate under its own weight into the seabed and secondly, after a short period of settlement, by pumping water out of the resulting suction chamber to apply suction.

Self-penetration of the pile ends when resistance to relative sliding movement between the skirt and the seabed soil balances the weight of the pile. Suction overcomes that resistance to force the skirt deeper into the seabed, hence enabling the pile to resist forces that will be applied after installation by equipment subsequently anchored to or supported on the pile.

Once embedded into the seabed soil and then left for a period for the surrounding soil to regain its strength, a suction pile can serve as a support or as an anchor for various types of subsea or surface equipment. The top plate serves as a convenient interface with the equipment that the suction pile is intended to support.

Suction piles can be used for various foundation purposes, for example for supporting a wellhead template that guides well casings or conductors extending into the seabed. This guiding function can even be integrated as a bore extending through the pile, as disclosed in EP 1264067. Similarly, WO 2017/179992 shows an exemplary configuration for suction piles that support a well template, with well conductors also running through the suction piles.

WO 2014/088770 describes the installation of a caisson for protecting a wellhead against impact, for example against gouging by sea ice. The caisson is firstly installed as a suction pile comprising a removable top plate. Then, the top plate of the caisson is removed and soil is excavated from within the top part of the caisson to define a protective recess for the wellhead.

EP 1881113 teaches dredging inside a suction pile during embedment. Dredging is performed by directing a jet or stream of water downwardly into the interior of the pile to soften and erode the plug of seabed soil within. The eroded soil, thus fluidised, may then be entrained in the water that is sucked out of the pile.

In WO 02/063106, a caisson is installed by hammering or vibrating a tubular base sleeve or ring of the caisson into the seabed. The base ring is shallow, being wider than it is high. Hammering or vibration continues until the top of the base ring lies level with the seabed. Then, most of the plug of seabed soil within the base ring is excavated.

Next, a hollow top ring of the caisson, extending above the surface, is lowered onto and sealed around the base ring to define an open-topped chamber. The chamber is then drained of water. This creates a dry environment for a concrete base slab to be placed or cast on top of the soil plug remaining within the base ring. A drilling template is then placed onto the base slab, accommodated in a recess between the base slab and the top of the base ring. The top ring of the caisson can then be removed, hence submerging the base slab and the drilling template. After drilling and completion activities are finished, a lid may be placed on top of the base ring. The drilling template is thereby surrounded and protected by the base ring and the lid.

A caisson solution extending from the seabed to above the surface as disclosed in WO 02/063106 is suitable for use only in very shallow water, merely five to ten metres deep. It would be entirely useless for installation in the much deeper water that is more usually encountered in the subsea oil and gas industry, which may be hundreds or even thousands of metres deep. In any event, the shallow caisson of WO 02/063106 is apt to engage firm seabed soil that characterises shallow water but is not apt to engage the soft seabed soil that characterises deep water.

EP 3222783 exemplifies how a plug or slab of grout, cement or concrete may be formed in the shallow void that remains within the interior of a suction pile after full embedment. The void is defined between the top plate of the suction pile and the top of the soil plug that is surrounded by the skirt. The plug may fill the void partially or fully. EP 3222783 is concerned mainly with the challenges that arise from such plugs when the time comes to remove suction piles from the seabed, for example when decommissioning a subsea installation.

The grout plug proposed by EP 3222783 is a thin or shallow slab, no more than 150 cm thick and preferably only about 50 cm thick, that is disposed in the void atop the soil plug within the pile. The thickness of the plug represents merely a small proportion of the overall height or length of the pile, which could typically be 10 m to 20 m. In this respect, it will be noted that the top surface of the soil plug is typically lifted above the level of the seabed surrounding the pile by virtue of the underpressure within the void. Thus, the bottom of the grout plug generally remains above the level of the surrounding seabed.

Conventional suction piles may not have enough load-bearing capacity to support large loads in very soft soils. Settlement under the influence of weight loads can be a particular challenge, for example for templates connected to a conductor. Here, the limit on settlement could be as little as 100 mm throughout the working life of the template. If settlement exceeds that limit, it may be difficult to make, or to maintain, connections from other subsea equipment to the supported structure, for example via spool pipes.

In principle, piles could simply be made bigger to increase their capacity. However, a sufficiently large pile could be too large to lift and install safely using an available offshore crane. More generally, large piles are correspondingly expensive to fabricate, to transport and to install.

There remains a need to improve the performance of hollow foundations in soft seabed soil, without necessarily increasing their size. This allows smaller cranes and vessels to be used for installation, greatly reducing the cost of installation and increasing the availability of suitable marine assets.

It is against this background that the present invention has been devised. From one aspect, the invention resides in a method of installing an upright elongate hollow subsea foundation that is higher than it is wide, the method comprising: at least partially embedding the foundation in seabed soil; and placing a partition layer within a flooded interior of the foundation, supported by a plug of the soil that is surrounded by a wall of the foundation. The partition layer is placed on the plug of soil within the foundation at a level that is spaced from the top of the foundation by at least 20% of the height of the foundation. Optionally, the partition layer may be placed at a level that is spaced from the top of the foundation by at least one third of the height of the foundation but preferably by no more than half of the height of the foundation.

The partition layer may be engaged with or left disengaged from the surrounding wall of the foundation.

To lower the level of the partition layer relative to the foundation, the plug of soil may be shortened by excavating soil from the plug before placing the partition layer on the plug. For example, soil may be excavated from the plug to a level below that of the seabed surrounding the foundation.

Soil may be excavated from the plug and removed from within the foundation after embedding the foundation, which may take place while the foundation remains substantially stationary relative to the surrounding seabed. Alternatively, the plug of soil may be shortened before embedding the foundation by: excavating a cavity in the seabed soil to below the level of the seabed surrounding the cavity; and embedding the foundation into the seabed soil within the cavity. In that case, the cavity may be infilled around the embedded foundation.

The foundation may be embedded under its self-weight, optionally supplemented by generating an underpressure within the foundation.

Conveniently, the partition layer may be placed by introducing a flow of grout or other flowable material into the foundation and then curing or compacting the grout or other material. It may also be possible to place the partition layer by lowering a slab into the foundation in one or more pieces.

The partition layer may be placed beneath a rigid body, such as a solid mass or a hollow chamber, that occupies an upper portion of the interior of the foundation. Preferably the partition layer is in supporting contact with the rigid body, thus being sandwiched between the rigid body and the underlying plug of soil within the foundation. A flowable material such as grout may be introduced through the rigid body to form the partition layer. For this purpose, the rigid body may be penetrated by a passageway extending from a top face of the rigid body to a bottom face of the rigid body.

The method of the invention may further comprise placing or supporting a subsea structure on the foundation, for example by lowering the subsea structure onto the foundation.

Conveniently, the structure can be rested on the wall of the foundation, and may be clamped to the wall of the foundation. It is also possible to support the structure on the partition layer within the foundation. In that latter case, at least one supporting leg of the structure may be lowered into the foundation to define a load path that extends along the or each leg and into the partition layer, or may be interposed between the structure and the partition layer to define such a load path. Optionally, the length of the or each supporting leg can then be adjusted to level or reposition the structure or to compensate for any settlement.

Correspondingly, the inventive concept embraces an elongate hollow foundation that is at least partially embedded in seabed soil in an upright orientation, the foundation being higher than it is wide and preferably at least twice as high as it is wide. The foundation contains a partition layer supported by a plug of soil that is surrounded by a wall of the foundation, the partition layer being at a level that is spaced from the top of the foundation by at least 20% of the height of the foundation. Thus, where the foundation is a suction pile, the partition layer may be spaced from the top plate that closes the top of the pile.

The inventive concept also embraces a combination of a foundation of the invention with a subsea structure supported by that foundation. The structure may extend vertically above the foundation or may extend laterally or horizontally beyond an outer diameter of the foundation.

In embodiments to be described, a volume of soil is excavated from within a hollow foundation and then is at least partially replaced with a very light infill, for example of concrete. Other lightweight infill materials that could be used include bentonite slurry or pulverised fly ash (PFA), also known as pulverised fuel ash. Another approach is to use grout or concrete to form a barrier or partition above soil excavated from within a hollow foundation, defining a water-filled cavity or chamber within the foundation above the partition. The effect is to reduce the effective stresses applied to the seabed via the foundation and hence to reduce settlement of the structure supported by the foundation over time.

By way of example, a typical monopile for a template could be 20 m long or high, with an outer diameter of 8 m. Replacing soil in the pile with concrete to a length or depth of 6 m could reduce the load applied to the seabed by the foundation by about 900 kN.

Another approach is to install an open pile or caisson into the seabed under gravity, optionally assisted by hammering or vibration, or with suction applied with the temporary assistance of a removable top plate. Soil may then be excavated from within the pile either by suction or mechanically, lowering the level of the soil within the pile to beneath the level of the surrounding seabed. A substantially level weight-bearing surface may then be created by grout deposited on top of the lowered soil surface within the pile.

Positioning lightweight concrete or other infill material to replace soil may take place before installing a structure. This could take advantage of the construction schedule to minimise in-place settlement.

Embodiments of the invention provide a method to improve the performance of a hollow foundation in soft soil, the method comprising: embedding the foundation in the soil; removing soil or other material from inside the foundation; and filling the interior of the foundation at least partially with a grout or other mass such as concrete. The foundation may then support at least part of the weight of a template or other structure resting on the foundation.

In some embodiments of the invention, the foundation is a suction pile that is embedded in seabed soil initially by self-penetration and then by suction. Soil removal may be effected during embedment of the pile, at least by pumping mud or other soil through a dedicated port in the top of the pile. Water may be injected to erode, mix and fluidise the soil for removal. A plug of concrete is then placed within the pile so that at least the upper third of the length of the pile contains substantially no soil. A structure such as a template may then be installed on the top of the pile.

The top of the pile may contain the concrete plug, which could substantially fill the top of the pile. Alternatively, the top of the pile may contain at least one hollow water-filled cavity, chamber, compartment or tank.

In other embodiments of the invention, the foundation may be an open pile such as a hollow cylinder or tube. Embedment may be achieved by self-penetration, which may be supplemented by hammering or vibrating the pile, by applying a deadweight to the pile, or by temporarily closing the top of the pile with a plate or cap to apply suction. Removal of material from within the pile may be effected by pumping, optionally supplemented by water injection, or by other excavation through the open top of the pile, for example using a mechanical excavator. A plug of concrete is placed on top of the soil that remains in the pile, near the bottom of the pile or spaced from the top of the pile, hence defining an open-topped cavity, recess or chamber within the top of the pile above the plug. The plug may therefore define, or support, the bottom of the cavity, recess or chamber.

A structure, such as a template, is then installed on top of the open pile. The structure lies substantially outside the pile, extending above the pile and typically also extending laterally or horizontally beyond the outer diameter of the pile. However, a supporting part of the structure may extend at least partially through the open top of the pile into the cavity to rest on the concrete plug inside the pile. Alternatively a separate support for the structure could be placed into the cavity to extend from the concrete plug to the structure, which may in that case lie wholly outside the pile, or nearly so. The supporting part of the structure, or the separate support, could be longer than the depth of the cavity between the open top of the pile and the concrete plug, and so may protrude from the open top of the pile.

Soil may be excavated from the seabed before embedding the pile. A residual volume or space around the pile may then be backfilled by rocks or soil after the pile has been embedded. The soil excavated or backfilled may be equivalent to the volume of the upper chamber or cavity of the pile, whether that chamber or cavity contains grout, water, a supporting part of the structure and/or a separate support for the structure.

Embodiments of the invention also provide a subsea structure comprising: a foundation having an open-topped pile and a concrete plug at the bottom of a cavity in the open top of the pile; a main structure above the seabed, connected to the foundation by a hang-off system; and an interface part disposed at least partially inside the cavity of the pile, resting on the concrete plug and transferring part of the weight of the main structure to the foundation.

The hang-off system may comprise formations that complement and attach to the top edge of the open-topped pile, such as a combination of an inverted gutter and radially-movable bolts. The interface part may be integral with or separate from the main structure.

In summary, the invention provides techniques for installing an upright elongate hollow subsea foundation that is higher than it is wide, such as a suction pile. The foundation is at least partially embedded in seabed soil. A partition layer is placed within the foundation, for example by injecting a grout, supported by a plug of soil that is surrounded by the foundation. The partition layer is placed on the plug of soil at a level that is spaced from the top of the foundation by at least 20% of the height of the foundation. Above the partition layer, the interior of the foundation may be filled with water and/or a rigid body, such as a solid mass or a hollow liquid-filled tank.

Figure 1B:
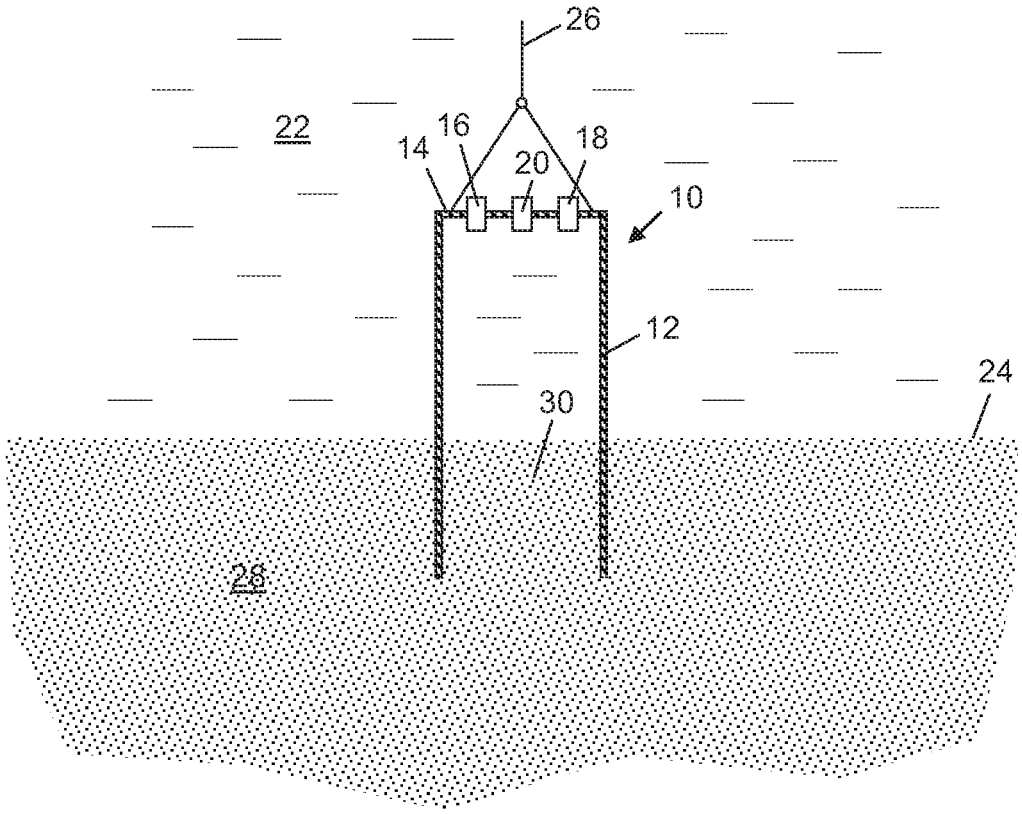
Figure 1C:
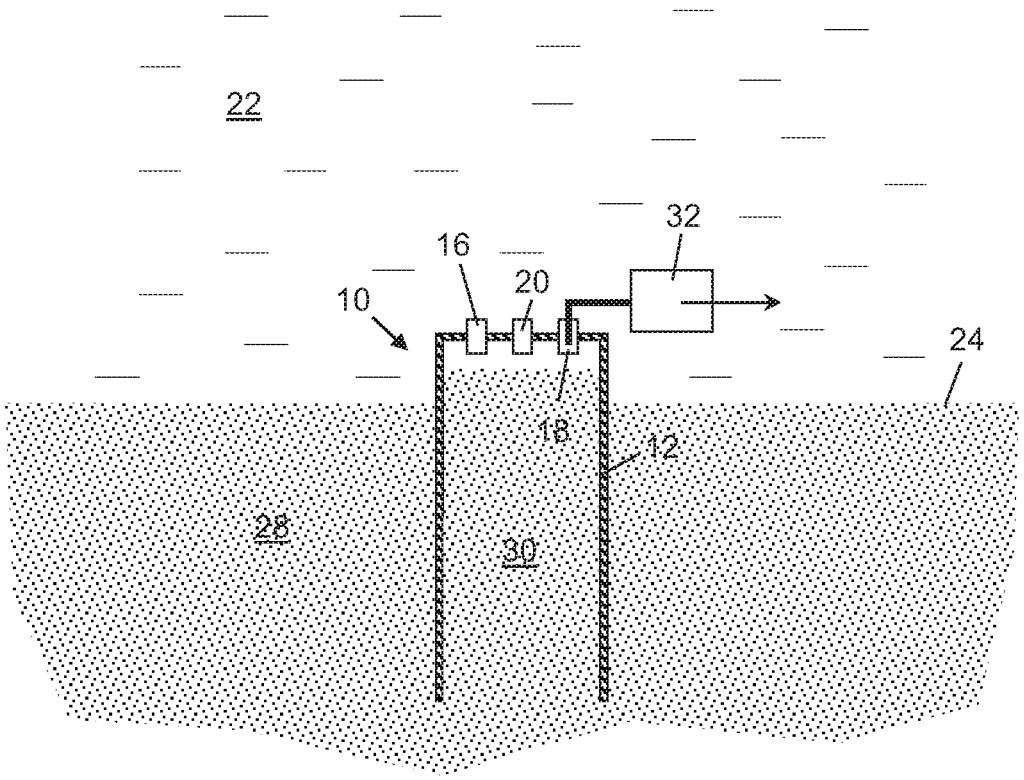
Figure 1D:
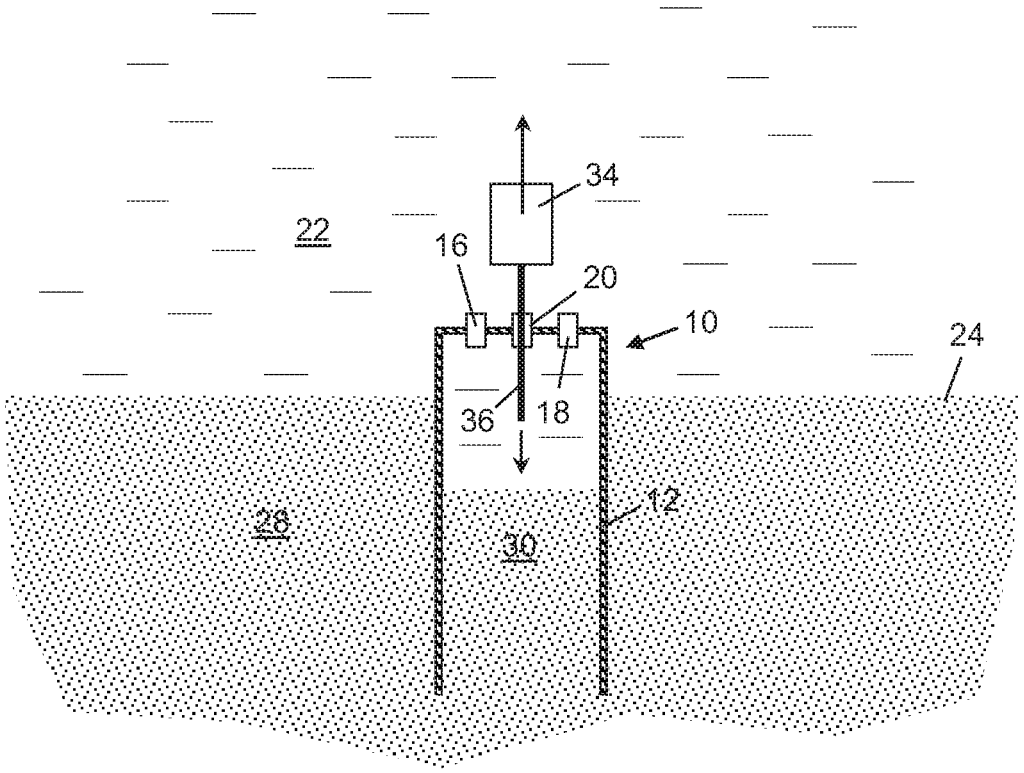
Figure 1E:
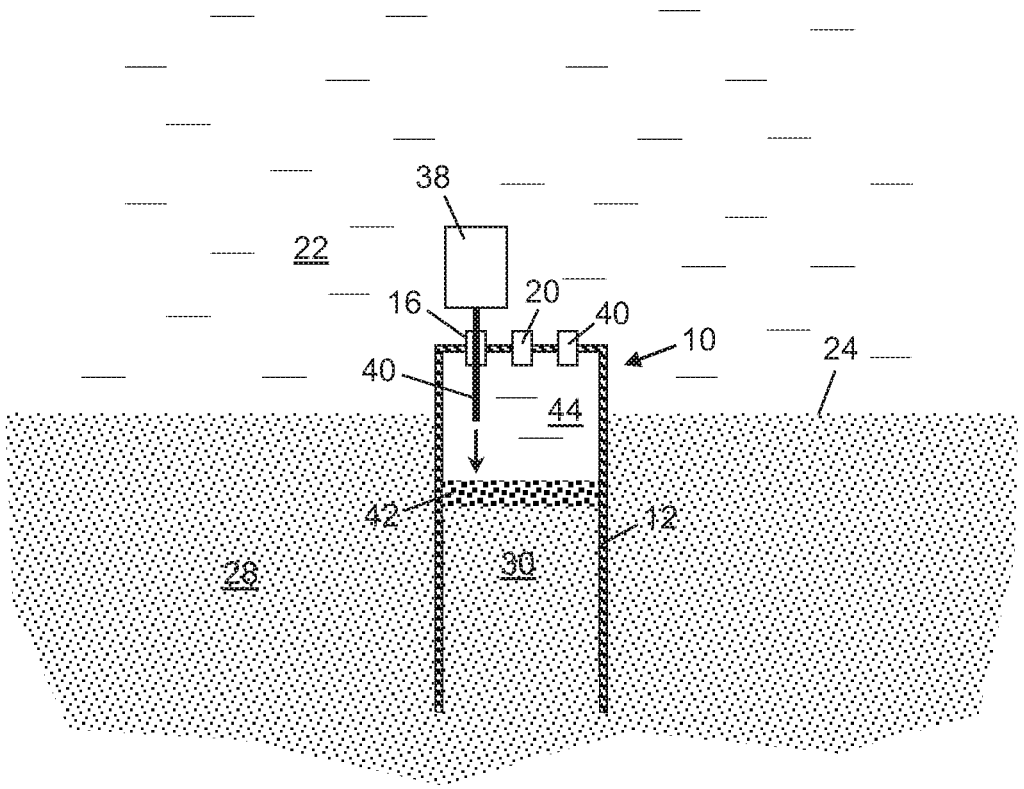
Figure 2:
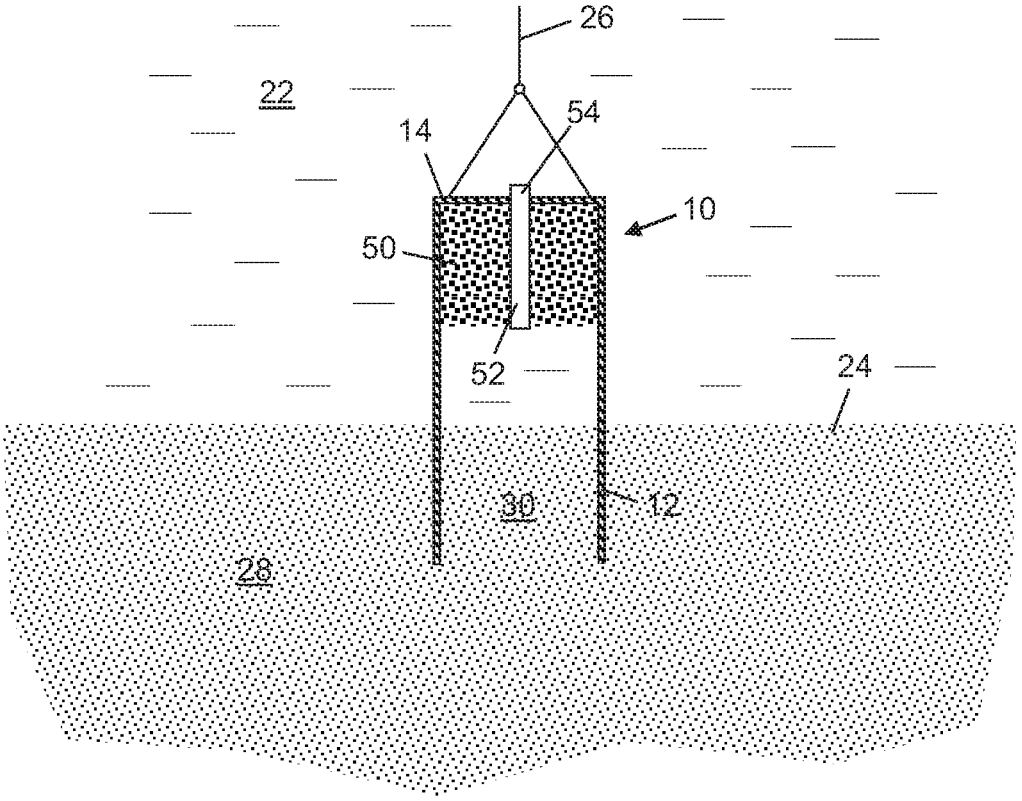
Figure 3A:
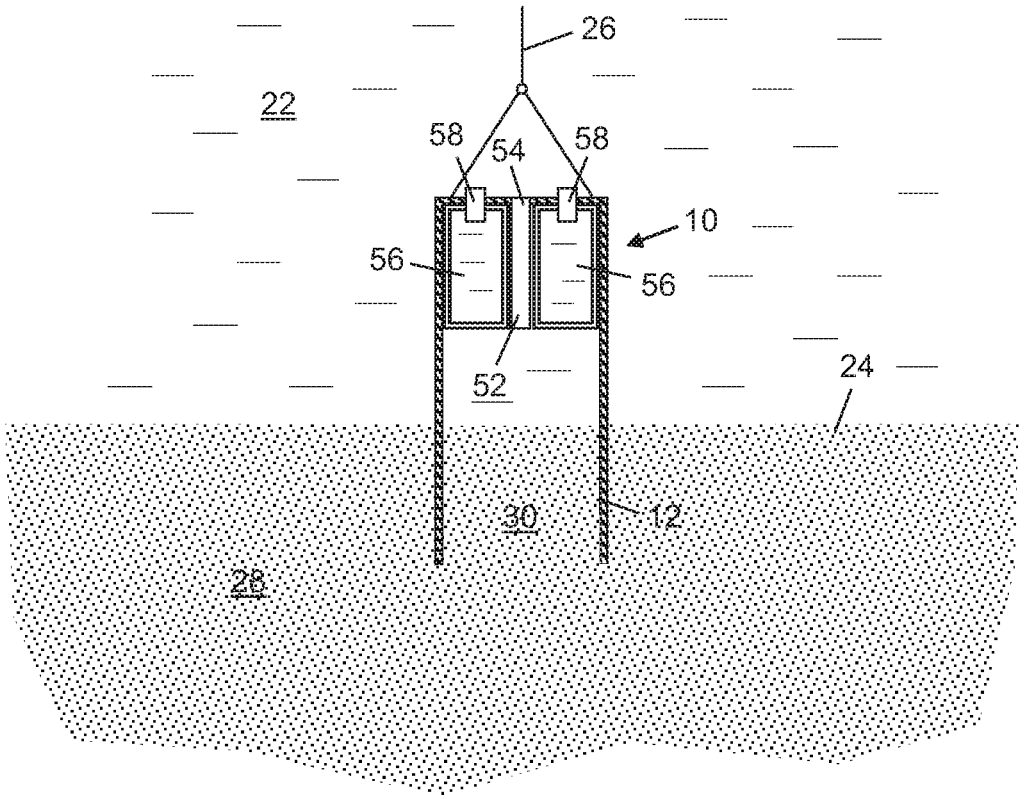
Figure 3B:
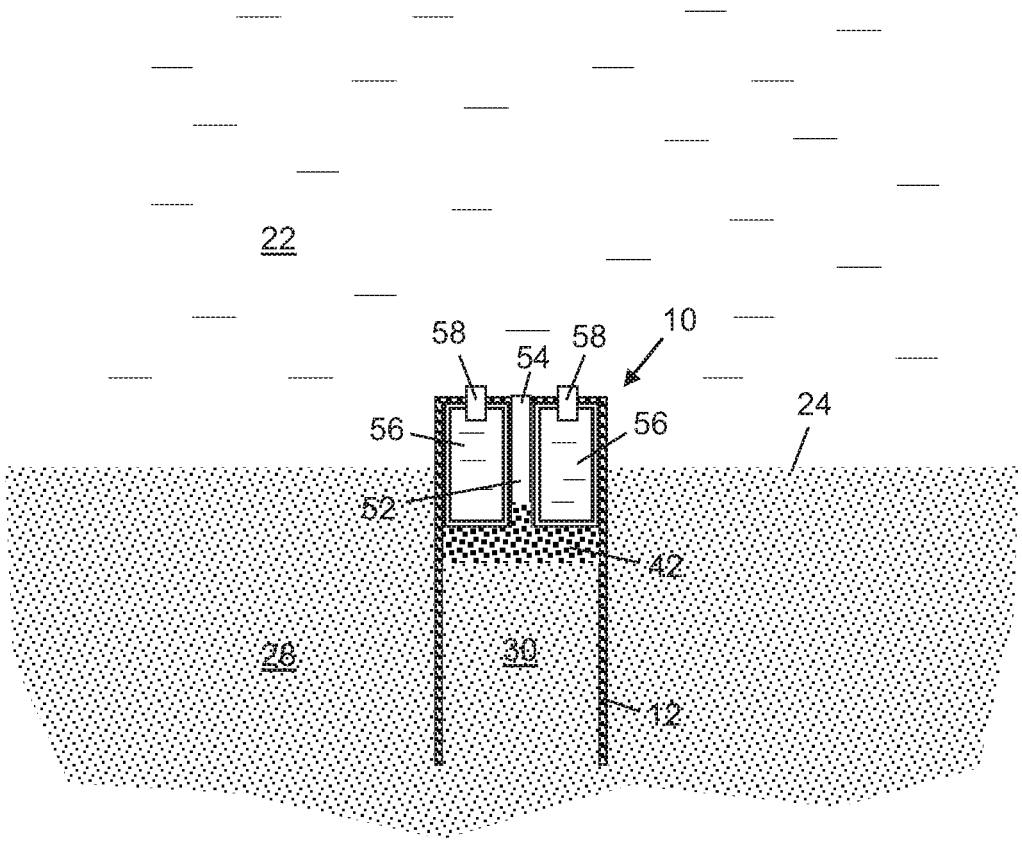
Figure 4A:
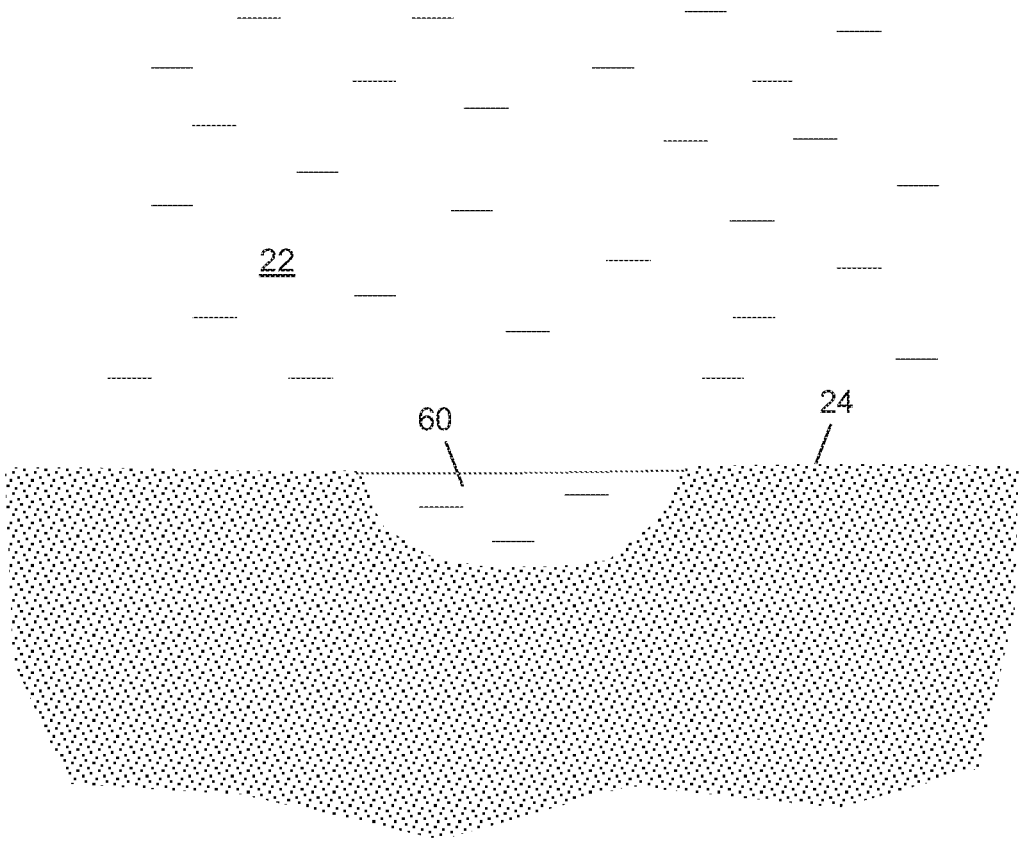
Figure 4B:
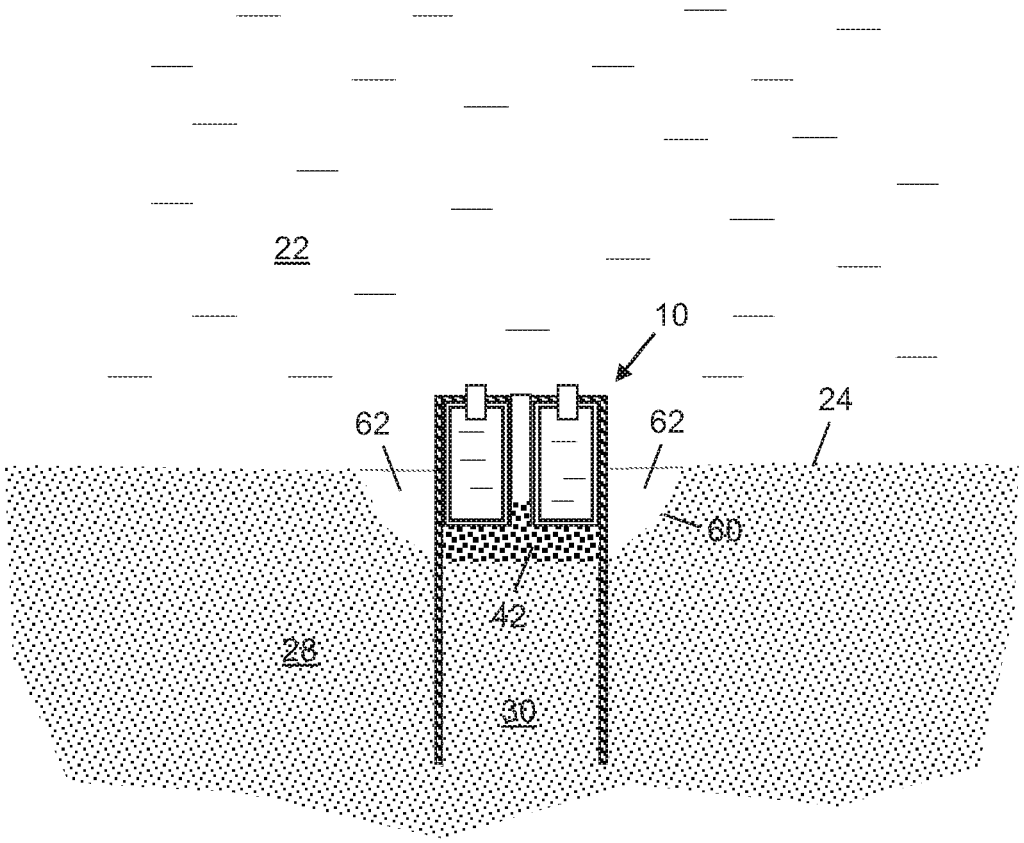
Figure 4C:
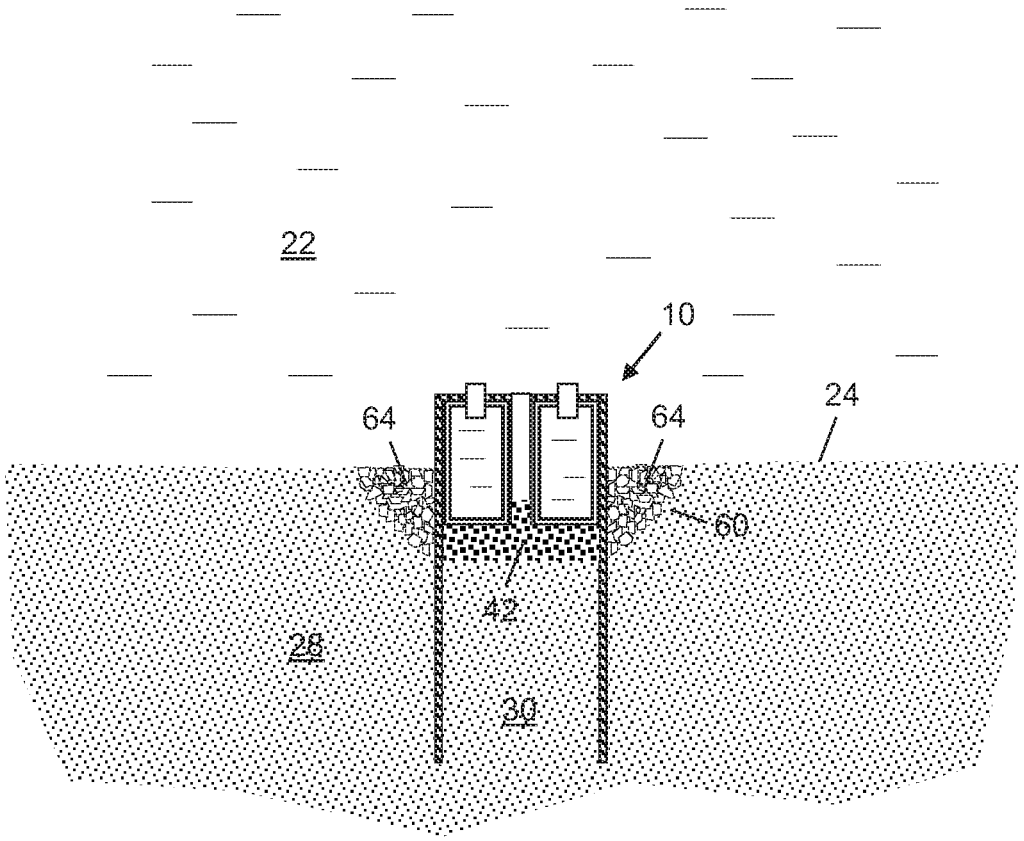

In order that the invention may be more readily understood, reference will now be made, by way of example, to the accompanying drawings in which:

FIGS. 1*a* to 1*f* are a sequence of schematic cross-sectional side views showing the installation of a suction pile in accordance with the invention;

FIG. 2 is a schematic cross-sectional side view of another suction pile of the invention;

FIGS. 3*a* and 3*b* correspond to the installation stages shown in FIGS. 1*b* and 1*e* but show another suction pile of the invention;

FIGS. 4*a* to 4*c* are a sequence of schematic cross-sectional side views that show another technique for installing the suction pile shown in FIGS. 3*a* and 3*b;*

Figure 5A:
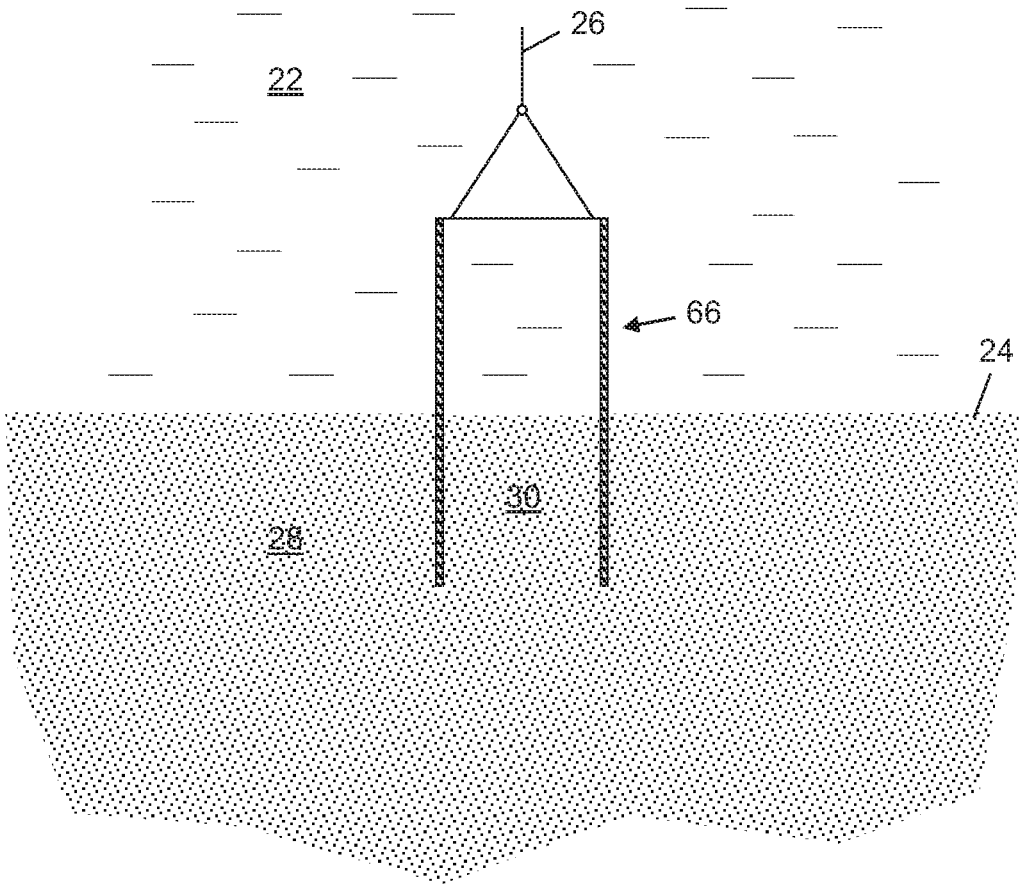
Figure 5B:
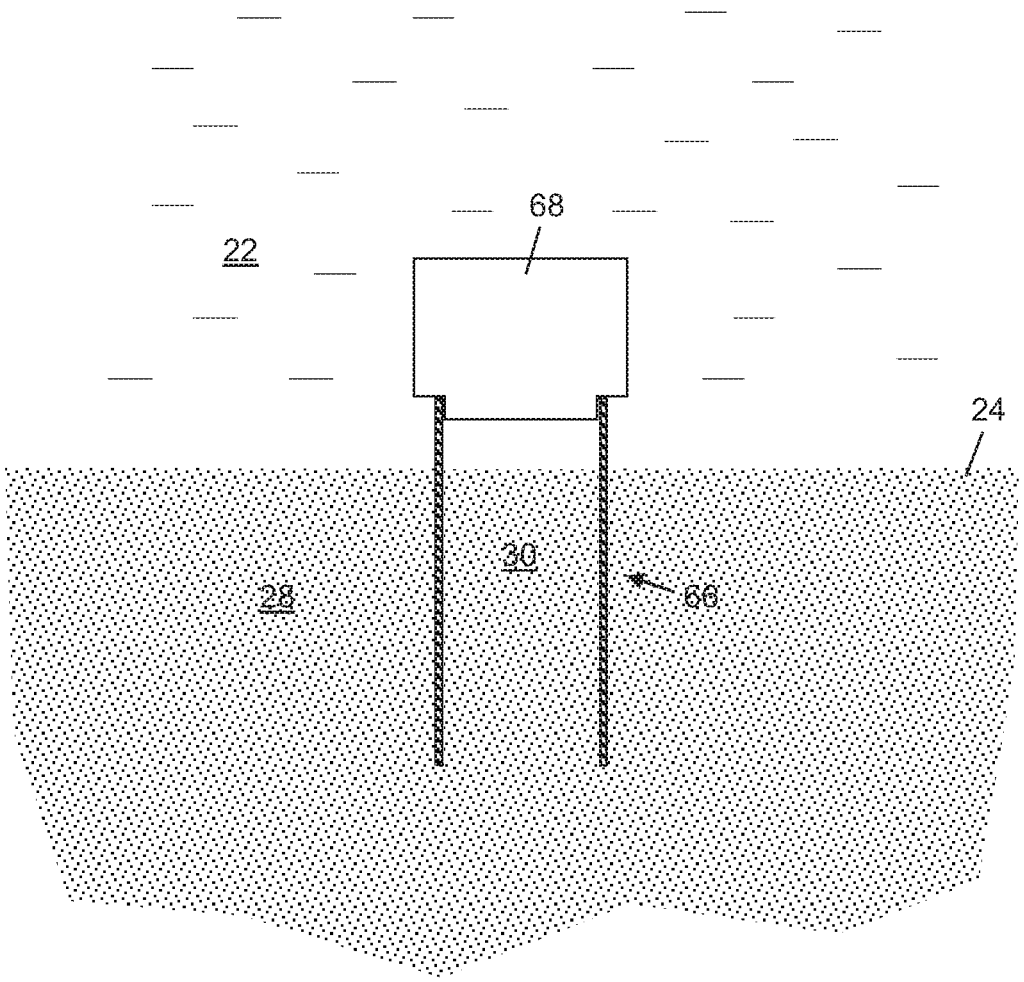
Figure 5C:
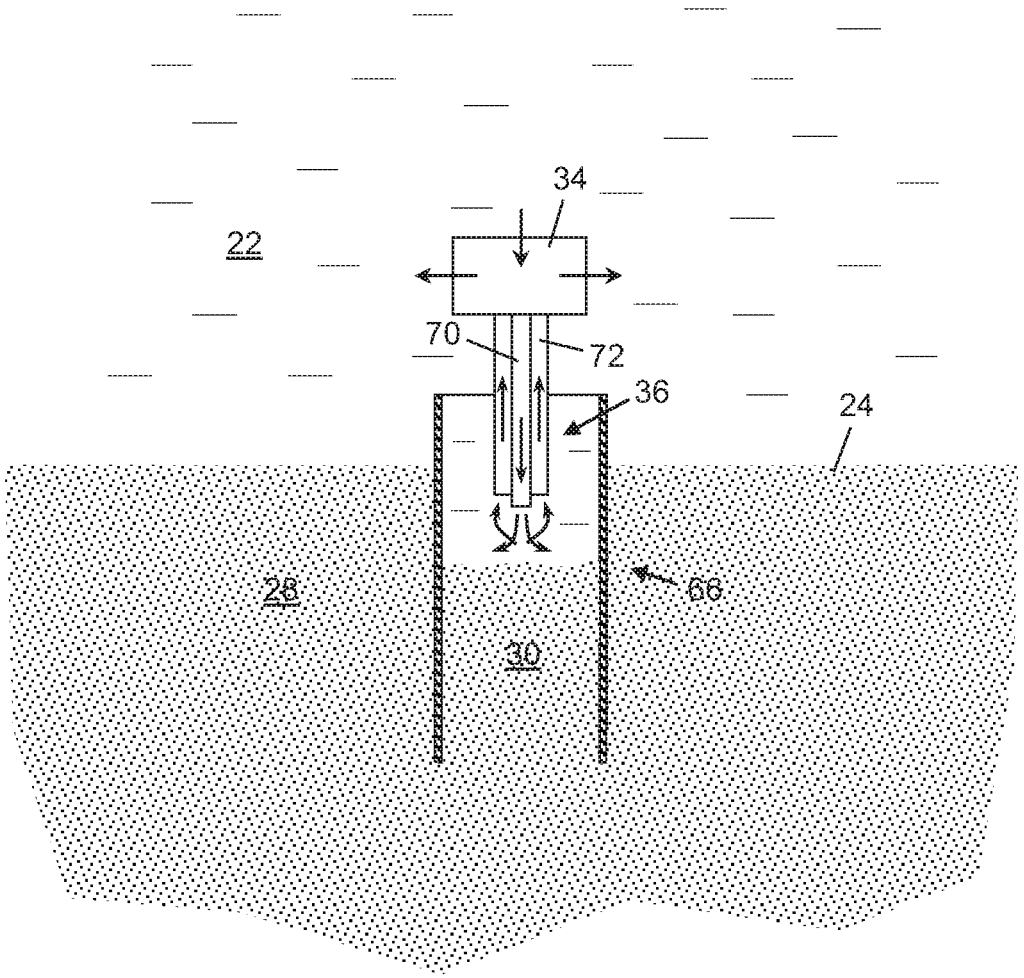
Figure 5D:
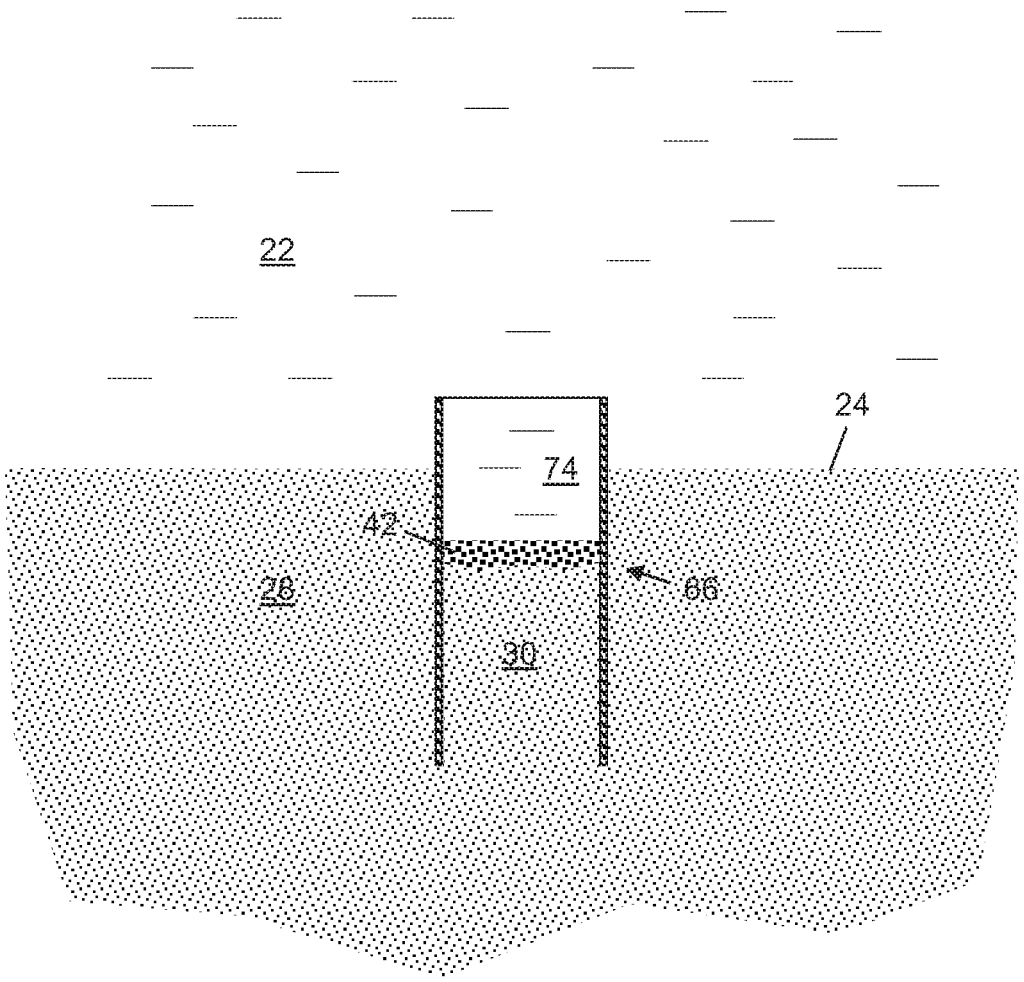
Figure 5E:
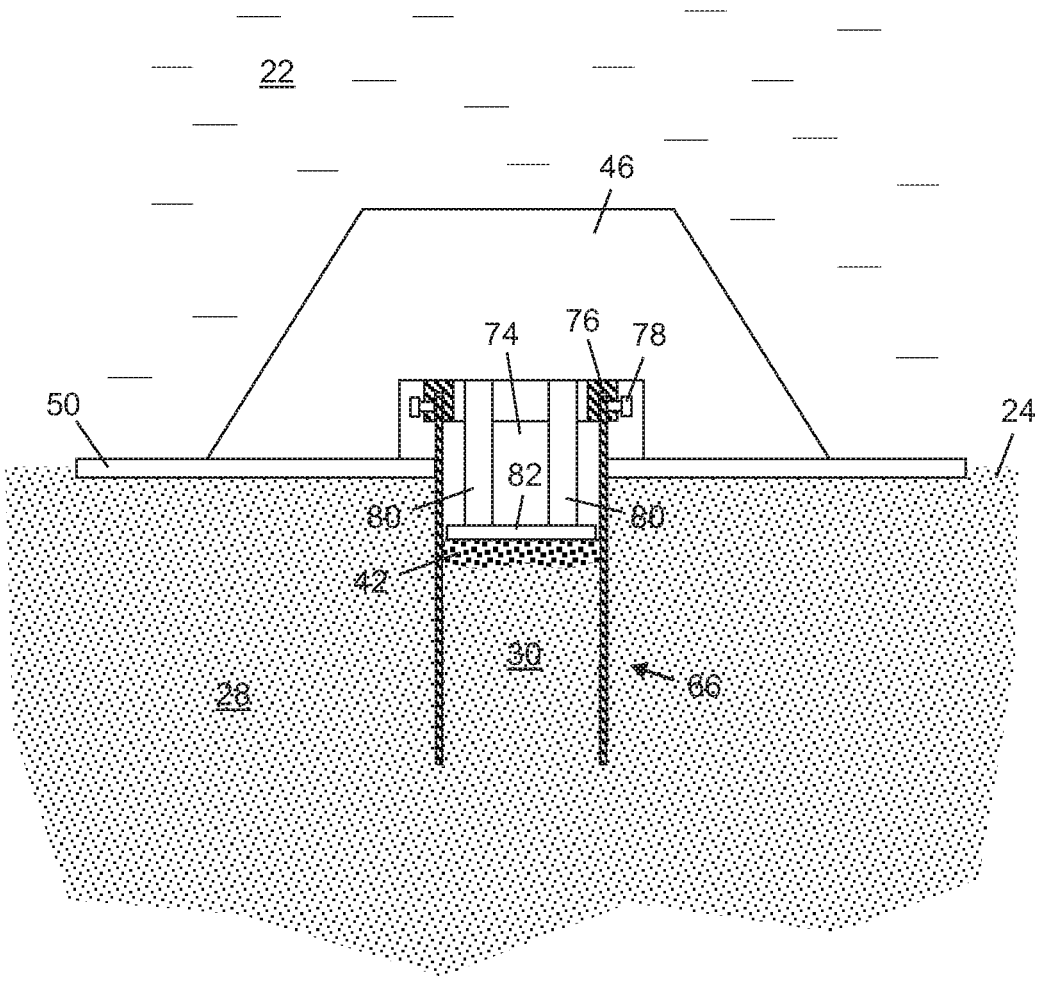
Figure 6:
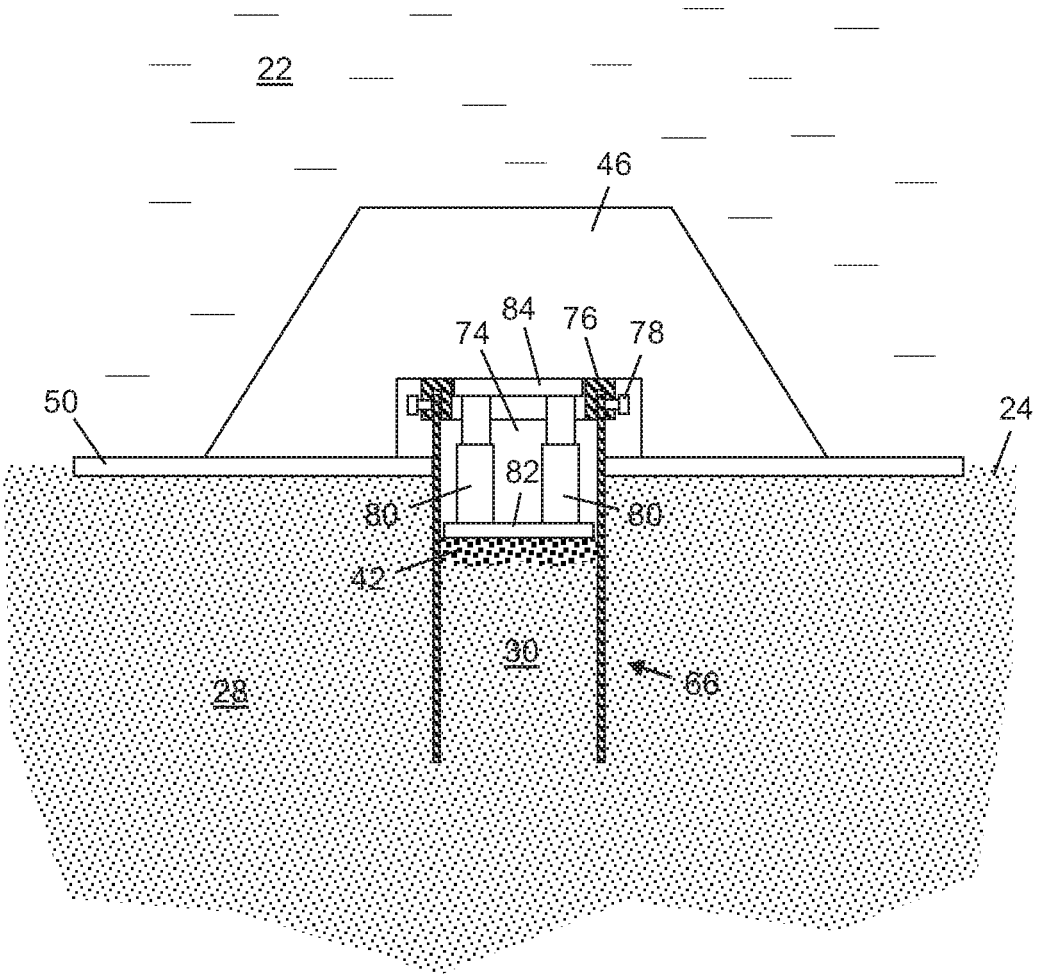

FIGS. 5*a* to 5*e* are a sequence of schematic cross-sectional side views that show the installation of an open caisson in accordance with the invention; and FIG. 6 shows a variant of a support arrangement shown in FIG. 5*e*.

Referring firstly to FIGS. 1*a* to 1*e* of the drawings, a subsea foundation of the invention is exemplified here by a suction pile 10. The pile 10 comprises a tubular skirt 12 that has an open bottom and a closed top. The skirt 12 is rotationally symmetrical about an upright central longitudinal axis. The top of the skirt 12 is closed by a substantially horizontal top plate 14.

In this example, the top plate 14 is penetrated by three ports each dedicated to a respective function, namely a grout injection port 16, a pumping port 18 and an excavation port 20. In practice, one port could serve two or more of those functions, for example being used initially for excavation and subsequently for injecting grout. There could therefore be fewer than three ports.

Any or all of the ports 16, 18, 20 may be fitted with valves or removable closures that close or seal the ports 16, 18, 20 when required and that can be opened to perform the function required. Such valves or closures have been omitted from these simplified views.

FIG. 1*a* shows the pile 10 being lowered in deep water 22 toward a soft seabed 24 comprising marine sediments or clay soil. The pile 10 is suspended from a wire 26 of a crane or winch aboard an installation vessel at the surface, potentially hundreds of metres above the seabed 24. The interior of the pile 10 is flooded with water 22.

FIG. 1*b* shows the skirt 12 of the pile 10 now partially embedded in the soil 28 of the seabed 24 under its self-weight and momentum. A plug 30 of soil 28 is trapped within the pile 10, surrounded by the skirt 12 as the bottom edge of the skirt 12 penetrates beneath the level of the seabed 24.

The ports 16, 18, 20 are typically open during lowering as shown in FIG. 1*a* and during initial embedment of the pile 10 as shown in FIG. 1*b*. This stabilises the pile 10 and reduces resistance to insertion into the soil 28 as the plug 30 of soil 28 acts like an upwardly-moving piston against the water 22 trapped within the pile 10. The trapped water 22 can then escape through the open ports 16, 18, 20.

In FIG. 1*c*, the wire 26 has been uncoupled from the pile 10. A suction pump 32 has been coupled to the pumping port 18 and activated to draw water 22 out from the interior of the pile 10, while the grout injection port 16 and the excavation port 20 are closed. This creates an underpressure within the pile 10 that draws the pile 10 deeper into the soil 28 of the seabed 24. The underpressure also lifts the top of the plug 30 of soil 28 above the level of the surrounding seabed 24.

The suction pump 32 may be integrated into the pile 10 or may be external to the pile 10, for example being implemented onboard a skid attached to a remotely-operable vehicle (ROV).

FIG. 1*d* shows an excavation tool 34 comprising an elongate wand 36 that is inserted into the pile 10 through the excavation port 20. In this example, the excavation tool 34 uses flows of water 22 to erode, fluidise, entrain and expel soil 28 from the top of the plug 30 trapped within the skirt 12 of the pile 10. An example of such an excavation tool 34 is also shown in FIG. 5*c* and will be described in more detail later. In principle, the suction and excavation operations of FIGS. 1*c* and 1*d* could be combined by using the excavation tool 34 also as a suction pump 32.

The wand 36 of the excavation tool 34 directs one or more jets of water downwardly and laterally to erode and fluidise the soil 28 from the plug 30 within the pile 10. The fluidised soil 28 is entrained in an outflow of water that contra-flows back up the wand 36 and is then expelled into the surrounding water 22. Excavation in this way lowers the top of the plug 30 to beneath the level of the surrounding seabed 24, effectively lightening the pile 10 and applying less stress to the adjoining soil 28 of the seabed 24.

When excavation is complete, FIG. 1*e* shows a grout injection tool 38 comprising an elongate injection tube 40 that is inserted into the pile 10 through the grout injection port 16. A thin horizontal plug or layer of grout 42, such as cement, is deposited on top of the lowered plug 30 of soil 28 within the pile 10. The grout 42 is denser than the water 22 but may be less dense than the soil 28. The grout 42 flows laterally and cures to form a partition layer that seals against and engages the full inner circumference of the skirt 12. This maintains a water-filled space, chamber or cavity 44 within the pile 10 between the top plate 14 and the layer of grout 42, and effectively restrains the pile 10 against excessive downward settlement relative to the seabed 24 under the loads of use.

The bottom face of the layer of grout 42 corresponds with the top of the plug 30 and so is at a level beneath the level of the surrounding seabed 24. In this example, the top face of the layer of grout 42 is also beneath the level of the surrounding seabed 24. Also, in this example, the layer of grout 42 occupies a minor portion of the volume between the top of the plug 30 and the top plate 14 of the pile 10. Conversely, the water-filled space, chamber or cavity 44 between the top plate 14 and the layer of grout 42 occupies more than one-third of the internal volume of the pile 10.

In other arrangements, the top face of the layer of grout 42 could instead be above the level of the surrounding seabed 24. Also, the layer of grout 42 could instead occupy a major portion, or indeed substantially all, of the volume between the top of the plug 30 and the top plate 14 of the pile 10. In that case, the layer of grout 42 itself could occupy more than one-third of the internal volume of the pile 10.

Figure 1F:
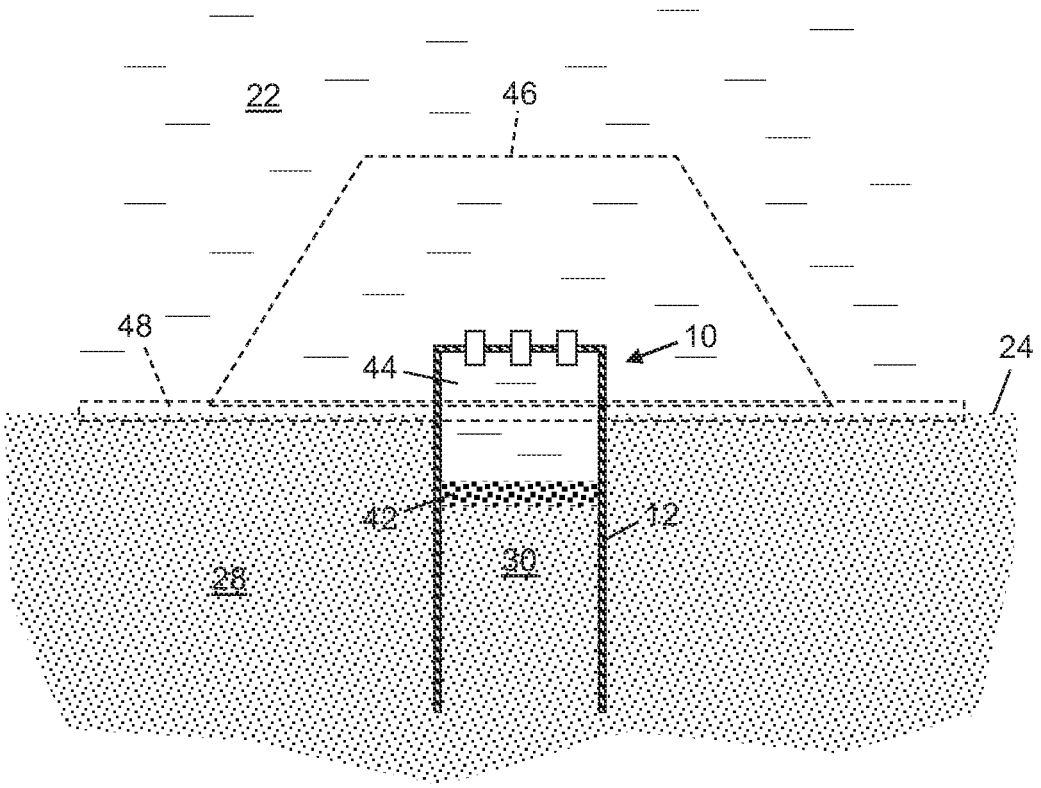

FIG. 1*f* shows a subsea structure such as a template 46 subsequently lowered to the seabed 24 and seated on top of the pile 10, which then serves as a foundation for the structure. In this example, the template 46 is also supported by a mudmat 48 that spreads the weight of the template 46 across an enlarged area of the seabed 24.

A structure such as a template 46 could instead be lowered with one or more piles 10 already integrated into the structure and hence may be lowered simultaneously with the or each supporting pile 10, which will then be subject to the installation operations described above and shown in FIGS. 1*b* to 1*e*.

FIG. 2 shows a variant of the pile 10 shown in FIGS. 1*a* to 1*f*, at a stage of initial embedment corresponding to that shown in FIG. 1*b*. In this variant, a pre-installed mass 50 of lightweight concrete fills an upper portion of the interior of the pile 10, occupying more than one-third of the internal volume of the pile 10. In this example, the concrete mass 50 extends downwardly from the top plate 14 of the pile 10. In other examples, there could be a gap between the top plate 14 and the concrete mass 50. The concrete mass 50 could therefore be a disc that is positioned at an intermediate level along the length or height of the pile 10. The concrete of the mass 50 is denser than the water 22 but may be less dense than the soil 28 of the seabed 24.

In FIG. 2, the concrete mass 50 surrounds a passageway 52 that extends downwardly from a multi-purpose port 54 that penetrates the top plate 14. The passageway 52 communicates with the port 54 and extends through the full height of the concrete mass 50.

The multi-purpose port 54 can be used selectively to apply suction, as shown in FIG. 1*c*, to the flooded interior of the pile 10 below the concrete mass 50. The port 54 can also be used to excavate soil 28, as shown in FIG. 1*d*, from the plug 30 below the concrete mass 50. The port 54 can then be used to inject grout 42, as shown in FIG. 1*e*, between the top of the plug 30 and the bottom of the concrete mass 50. The result of injecting grout 42 will be akin to that shown in FIG. 3*b*, to be described below.

FIGS. 3*a* and 3*b* show a further variant of the pile 10 shown in FIG. 2, Here, the concrete mass 50 is replaced by one or more chambers, cavities or tanks 56 for holding water 22. Like the concrete mass 50, the tanks 56 are rigid bodies with which the layer of grout 42 is in supporting contact. There may be two or more tanks 56 spaced angularly around the central longitudinal axis of the pile 10 or a single tank 56 that encircles the central longitudinal axis. The or each tank 56 has open ports 58 in fluid communication with the surrounding water 22 and so remains flooded.

Again, a passageway 52 extends downwardly from a multi-purpose port 54 that penetrates the top plate 14 of the pile 10. The passageway 52 extends through, or between, the or each tank 56 to effect fluid communication between the port 54 and the hollow interior of the pile 10 below the tanks 56.

Once the pile 10 has been partially embedded in the soil 28 as shown in FIG. 3*a*, the port 54 can be used selectively to apply suction, as shown in FIG. 1*c*, to the flooded interior of the pile 10 below the tanks 56 and to excavate soil 28, as shown in FIG. 1*d*, from the plug 30 below the tanks 56. Then, as shown in FIG. 3*b*, grout 42 is injected through the port 54 to flow laterally from the passageway 52 into a shallow space between the bottom of the tanks 56 and the top of the plug 30, The resulting layer of grout 42 cures to seal against and engage the full inner circumference of the skirt 12, in a manner similar to FIG. 1*e*.

It is possible for any pile 10, caisson or other foundation of the invention to be installed in the base of a depression, hollow or cavity that is pre-excavated in the seabed 24. In effect, this allows the pile 10 to embed simply by self-penetration to a required depth relative to the seabed 24 that surrounds the cavity. This therefore obviates or reduces the need to apply suction or other assistance to embed the pile 10 to the required depth. Also, in effect, the top of the plug 30 is pre-excavated by digging the cavity, which reduces the height of the plug extending upwardly within the pile 10. This therefore obviates or reduces the need for excavation of the plug 30 within the pile 10.

In this respect, reference is made to FIGS. 4*a* to 4*c* that show a downwardly-tapering cavity 60 extending below the level of the surrounding seabed 24. The cavity 60 is shallower than the length or height of the pile 10. However, the cavity 60 is wider than the outer diameter of the pile 10, extending down from the level of the surrounding seabed 24 to where the inclined wall of the cavity 60 intersects the outer surface of the skirt 12.

FIG. 4*a* shows the cavity 60 in the seabed 24 immediately after excavation. FIG. 4*b* shows the pile 10 of FIGS. 3*a* and 3*b* lowered into the cavity 60 and fully embedded and grouted with grout 42 as shown in FIG. 3*b*.

To the extent that the cavity 60 is wider than the outer diameter of the pile 10, a trench 62 encircles the embedded pile 10. The trench 62 extends downwardly from the level of the surrounding seabed 24 to the intersection of the wall of the cavity with the skirt 12 of the pile 10. The trench 62 is then backfilled as shown in FIG. 4*c*, for example using a dumped mass of soil or rocks 64 as shown.

In the example shown in FIGS. 4*b* and 4*c*, the layer of grout 42 is approximately level with the bottom of the cavity 60. More specifically, the top of the plug 30 and hence the bottom face of the layer of grout 42 is substantially level with the bottom of the cavity 60. However, the bottom face of the layer of grout 42 could lie below or above the bottom of the cavity 60. Similarly, the top face of the layer of grout 42 could lie below or above the bottom of the cavity 60.

The remaining drawings show a subsea foundation of the invention in the form of an open tubular caisson 66.

FIG. 5*a* shows the caisson 66 initially embedded in the soil 28 of the seabed 24 after being lowered onto the seabed 24 suspended from a wire 26, corresponding to the status of the suction pile 10 shown in FIG. 1*b*.

FIG. 5*b* shows a penetration driver 68 engaged with the exposed open top of the pile 10, which is now embedded to a sufficient extent in the soil 28 of the seabed 24. The penetration driver 68 could be a deadweight or could be arranged to vibrate or to hammer the pile 10 down into full engagement with the soil 28.

In FIG. 5*c*, an excavation tool 34 is being used to excavate soil 28 from the top of the plug 30 surrounded by the tubular wall of the caisson 66. This excavation has lowered the top of the plug 30 to below the level of the surrounding seabed 24. In this example, as in FIG. 1*d*, the excavation tool 34 uses water contra-flowing along an elongate wand 36 to erode, fluidise, entrain and expel the soil 28. Specifically, the wand 36 contains concentric or parallel channels, one channel 70 for downward flow to emit a jet of water from the distal end of the wand 36, and the other channel 72 for upward flow to draw the fluidised soil 28, entrained in water, up the wand 36 and out of the caisson 66, The excavation tool 34 therefore has an inlet for drawing in surrounding water 22 and an outlet for expelling the fluidised soil 28 mixed with water.

FIG. 5*d* shows a layer of grout 42 such as cement deposited on top of the excavated plug 30. Advantageously, the grout 42 can flow under gravity so that its top face is substantially level and horizontal even if its bottom face undulates to follow an uneven top surface of the excavated plug 30. Once cured to form a solid concrete disc, the grout 42 therefore provides a substantially flat and horizontal base for a subsequently-lowered subsea structure such as the template 46 shown in FIG. 5*e*.

The layer of grout 42 forms the base of an open-topped flooded cavity 74 that is recessed into the top of the caisson 66 and is surrounded by the upstanding peripheral wall of the caisson 66. The cavity 74 may, for example, extend longitudinally to more than a third of the length or height of the caisson 66.

In the example shown in FIG. 5*e*, the template 46 is supported by the caisson 66 in two ways. Either or both of those support arrangements may be adopted, preferably both.

Firstly, an inverted U-section channel 76 on the underside of the template 46 matches the shape and circumference of the circular top edge of the caisson 66. This downwardly-opening channel 76 receives and engages the top edge of the caisson 66 when the template 46 is lowered onto the caisson 66. Clamping or fastening devices such as radially-movable bolts 78 act between the channel 76 and the caisson 66 to fix the template 46 to the top of the caisson 66. The channel 76 may be continuous or discontinuous, in the latter case with angularly-spaced gaps between separate downwardly-depending clamp formations that engage the top of the caisson 66.

Secondly, the template 46 has one or more integral legs 80 that project downwardly below the base of the template 46, which is defined in this example by the mudmat 48. The or each leg 80 extends into the cavity 74 through its open top to rest on the layer of grout 42 at the base of the cavity 74. The legs 80 terminate at their lower ends in one or more enlarged feet, in this example defined by a horizontal bottom plate 82 that extends across most of the width of the layer of grout 42.

Thus, by virtue of the preferred combination of support arrangements shown in FIG. 5*e*, weight loads of the template 46 are fed directly to the wall of the caisson 66 and also directly to the plug 30 of soil 28 within the caisson 66. The optional mudmat 48 provides a further load path between the template 46 and the seabed 24.

Finally, FIG. 6 shows a variant of the support arrangements shown in FIG. 5*e*. In this example, the or each leg 80 is not integral with the template 46 but instead is part of a separate support structure that extends vertically from the layer of grout 42 at the base of the cavity 74 to the base of the template 46.

The support structure shown in FIG. 6 comprises a horizontal upper plate 84 on the upper end of the or each leg 80, on which the template 46 rests. Thus, a load path extends from the template 46, through the upper plate 84, along the or each leg 80 and through the bottom plate 82 into the layer of grout 42 that surmounts the plug 30 of soil 28 within the caisson 66. As before, further load paths extend from the template 46 into the wall of the caisson 66 via the channel 76 and from the template 46 into the seabed 24 via the optional mudmat 48.

FIG. 6 shows another feature that may also be applied to the embodiment shown in FIG. 5*e*, namely a provision for the length of the or each leg 80 to be adjusted. For example, the or each leg 80 may be telescopic as shown, may preferably be adjustable independently and could possibly be actuated hydraulically whenever required. This facility for height adjustment allows for load management, for levelling the template 46 and for compensating for any settlement of the foundation over time.

In principle, the concrete disc cast in situ as a layer of grout 42 in FIGS. 5*d*, 5*e* and 6 could be replaced by a prefabricated concrete slab that is lowered through the open top of the caisson 66 and laid on top of the excavated plug 30. Such a slab could be lowered into the cavity 74 in one or more pieces or sections.

Many other variations are possible within the inventive concept. For example, the piles and caissons shown in the drawings are shown as protruding slightly above the surrounding seabed when fully installed. However, it would be possible instead for the top of a pile or caisson to be substantially level with the surrounding seabed or even to be recessed slightly beneath the level of the surrounding seabed.

In principle, the open top of a caisson precludes the use of suction to embed the caisson. However, the caisson could be installed as a suction pile with the temporary addition of a top plate to close its open top. In that case, once the caisson is fully embedded with the assistance of suction, the top plate can be removed to enable further operations. In particular, the top plate can be removed before or after excavating soil from the plug that is encircled by the tubular wall of the caisson, or before or after depositing a layer of grout on top of the plug.

In other variants, the excavation tool could dig and lift the soil mechanically, for example using an auger screw. Again, such an excavation tool could be supported by an ROV.

The invention claimed is:

1. A method of installing an upright elongate hollow subsea foundation that is higher than it is wide, the method comprising:
   - at least partially embedding the foundation in seabed soil;
   - shortening a plug of the soil that is surrounded by a wall of the foundation by excavating soil from the plug; and
   - after shortening the plug, placing a partition layer within a flooded interior of the foundation, supported by the plug;
   - wherein the partition layer is placed on the plug of soil within the foundation at a level that is spaced from the top of the foundation by at least 20%, but no more than half, of the height of the foundation.

2. The method of claim 1, comprising engaging the partition layer with the surrounding wall of the foundation.

3. The method of claim 1, comprising excavating the soil from the plug to a level below that of the seabed surrounding the foundation.

4. The method of claim 1, comprising excavating the soil from the plug from within the foundation after embedding the foundation.

5. The method of claim 4, comprising excavating the soil from the plug while the foundation remains substantially stationary relative to the surrounding seabed.

6. The method of claim 1, comprising shortening the plug before embedding the foundation by:
   - excavating a cavity in the seabed soil to below the level of the seabed surrounding the cavity; and
   - embedding the foundation into the seabed soil within the cavity.

7. The method of claim 6, further comprising infilling the cavity around the embedded foundation.

8. The method of claim 1, comprising embedding the foundation under its self-weight.

9. The method of claim 1, comprising embedding the foundation by generating an underpressure within the foundation.

10. The method of claim 1, comprising placing the partition layer by introducing a flow of grout into the foundation and then curing the grout.

11. The method of claim 1, comprising placing the partition layer by lowering a slab into the foundation.

12. The method of claim 1, comprising placing the partition layer beneath a rigid body that occupies an upper portion of the interior of the foundation.

13. The method of claim 12, wherein the partition layer is in supporting contact with the rigid body.

14. The method of claim 12, wherein the rigid body is a solid mass or a hollow chamber.

15. The method of claim 12, comprising directing a flowable material through the rigid body to form the partition layer.

16. The method of claim 1, further comprising supporting a subsea structure on the foundation.

17. The method of claim 16, comprising resting the structure on the wall of the foundation.

18. The method of claim 17, comprising clamping the structure to the wall of the foundation.

19. The method of claim 16, comprising supporting the structure on the partition layer within the foundation.

20. The method of claim 19, comprising lowering at least one supporting leg of the structure into the foundation and into contact with the partition layer.

21. The method of claim 19, comprising interposing at least one supporting leg between the structure and the partition layer.

22. The method of claim 20, comprising adjusting the length of the or each supporting leg.

23. The method of claim 1, comprising placing the partition layer at a level that is spaced from the top of the foundation by at least one third of the height of the foundation.

24. A combination comprising:
   - an elongate hollow foundation at least partially embedded in seabed soil in an upright orientation, the foundation being higher than it is wide, wherein the foundation contains a partition layer supported by a plug of soil that is surrounded by a wall of the foundation, the partition layer being at a level that is spaced from the top of the foundation by at least 20%, but no more than half, of the height of the foundation; and
   - a subsea structure supported by the foundation, wherein the structure rests on a wall of the foundation and is supported on the partition layer within the foundation, and wherein at least one supporting leg of the structure extends into the foundation and into contact with the partition layer.

25. The combination of claim 24, wherein the structure is clamped to the wall of the foundation.

26. The combination of claim 24, comprising at least one supporting leg interposed between the structure and the partition layer.

27. The combination of claim 24, wherein the length of the or each supporting leg is adjustable.

28. The combination of claim 24, wherein the structure extends above the foundation.

29. The combination of claim 24, wherein the structure extends laterally or horizontally beyond an outer diameter of the foundation.

* * * * *